US006920656B2

(12) United States Patent
Roussy

(10) Patent No.: US 6,920,656 B2
(45) Date of Patent: Jul. 26, 2005

(54) HEIGHT ADJUSTABLE BED AND AUTOMATIC LEG STABILIZER SYSTEM THEREFOR

(75) Inventor: Richard Brian Roussy, London (CA)

(73) Assignee: Carroll Healthcare, Inc., London (CA)

( * ) Notice: Subject to any disclaimer, the term of this patent is extended or adjusted under 35 U.S.C. 154(b) by 0 days.

(21) Appl. No.: 10/380,875

(22) PCT Filed: Sep. 28, 2001

(86) PCT No.: PCT/CA01/01362

§ 371 (c)(1),
(2), (4) Date: Mar. 19, 2003

(87) PCT Pub. No.: WO02/26187

PCT Pub. Date: Apr. 4, 2002

(65) Prior Publication Data

US 2003/0172459 A1 Sep. 18, 2003

Related U.S. Application Data

(60) Provisional application No. 60/236,388, filed on Sep. 29, 2000.

(51) Int. Cl.[7] ..... A61G 7/012
(52) U.S. Cl. ..... 5/611; 5/86.1; 16/19; 16/32
(58) Field of Search ..... 296/20; 5/611, 5/86.1; 16/19, 32, 34

(56) References Cited

U.S. PATENT DOCUMENTS

| | | | | | |
|---|---|---|---|---|---|
| 1,999,106 | A | * | 4/1935 | Muller | 16/34 |
| 2,675,285 | A | | 4/1954 | Terry et al. | |
| 3,203,010 | A | | 8/1965 | Smith | |
| 3,305,876 | A | | 2/1967 | Hutt | |
| 3,676,881 | A | | 7/1972 | Duprey | |
| 4,503,844 | A | | 3/1985 | Siczek | |
| 5,245,718 | A | | 9/1993 | Krauska | |
| 5,257,428 | A | | 11/1993 | Carroll et al. | |
| 5,347,682 | A | * | 9/1994 | Edgerton, Jr. | 16/34 |
| 5,432,966 | A | * | 7/1995 | Berta et al. | 5/611 |
| 5,438,723 | A | | 8/1995 | Carroll | |
| 5,594,961 | A | | 1/1997 | Yokoi et al. | |
| 5,720,059 | A | | 2/1998 | Allevato et al. | |
| 6,230,344 | B1 | | 5/2001 | Thompson et al. | |
| 6,405,393 | B2 | | 6/2002 | Megown | |
| 6,473,921 | B2 | * | 11/2002 | Brooke et al. | 5/600 |
| 6,601,251 | B2 | * | 8/2003 | Paul | 5/611 |
| 2001/0047547 | A1 | | 12/2001 | Paul | |

FOREIGN PATENT DOCUMENTS

| | | |
|---|---|---|
| DE | 199 15 431 | 10/2000 |
| EP | 558108 | 9/1996 |
| EP | 1155670 | 11/2001 |
| FR | 2704143 | 10/1994 |
| FR | 2769832 | 4/1999 |
| GB | 1084020 | 9/1967 |
| WO | WO 01/74286 | 10/2001 |

OTHER PUBLICATIONS

Advertisement for Joerns UltraCare Universal Care Bed, (Sunrise Medical, 1999).
Advertisement for Eurocare Bed, (Kokuyo).
Maxxum Series Low Bed, Advertising Brochure (M.C. Healthcare Products Inc., Jan., 2003).

* cited by examiner

*Primary Examiner*—Michael Trettel
(74) *Attorney, Agent, or Firm*—Calfee, Halter & Griswold LLP

(57) ABSTRACT

A vertically adjustable bed includes a bed frame attached to movable legs powered by a motor. Operation of the motor causes the legs to move longitudinally along a guide rod, collapsing the legs beneath the bed and moving the bed frame vertically. Collapsing the bed to its substantially lowermost position compresses a spring. The energy stored by the compression of the spring is used to raise the bed from its substantially lowermost position. Pivotally attached to the legs is a caster and foot arrangement. During normal operation, the foot engages the floor. When the bed frame moves to its substantially uppermost position, a pin extending from the leg engages one end of a slot, causing the caster to pivot and engage the floor, rendering the bed horizontally mobile.

30 Claims, 3 Drawing Sheets

HEIGHT ADJUSTABLE BED AND AUTOMATIC LEG STABILIZER SYSTEM THEREFOR

CROSS-REFERENCES

This application is a PCT National Entry of International Application PCT/CA01/01362 filed on Sep. 28, 2001. This application claims the benefit of U.S. provisional application Ser. No. 60/236,388 filed Sep. 29, 2000.

BACKGROUND OF THE INVENTION

Field of the Invention

The present invention relates to improvements in a vertically adjustable mechanical bed. Such a bed may be lowered or raised as required by an operator by means of motor activation. The bed is used in its "lower most positions" to minimize the risk of injury to persons who may through inattention or infirmity fall out of the bed. The lower the height, the less risk of injury. The bed is used in its "upper most" positions to enable personnel to perform their functions with respect to the bed or its occupant without bending down or having to work in an awkward physical position.

SUMMARY OF THE INVENTION

One aspect of the present invention is to provide the bed with a foot/caster leg arrangement which enables the bed to remain in a stable or non mobile condition on the floor surface resting on the foot portion of the leg over almost the entire range of vertical travel. As the bed frame reaches its upper most point, the novel foot/caster leg arrangement of the present invention will automatically pivot onto the caster portion of the leg which permits mobility. The bed according to the present invention is almost always in the stable position resting on the foot portion through almost the entire range of vertical travel. At about prior to the highest position, the bed becomes mobile as the weight of the bed is transferred onto the casters that have automatically come into contact with the floor or ground as hereinafter described.

According to another aspect of the invention, the bed frame may be elevated or lowered using the described linkage mechanisms and arrangements such that the bed frame moves vertically over the same "footprint". In other words, the bed frame moves upwardly or downwardly without any longitudinal or horizontal component of travel. One of the advantages associated with this type of "straight up and down" feature is that the end of the bed frame immediately adjacent, for example, a wall, will not move away from the wall or into the wall with the consequent possibility of property damage or personal injury.

The present invention in one embodiment provides a bed having a bed frame and a pair of motor powered leg means operable to vertically raise and lower the bed frame over a range of heights between a lowermost and uppermost position. The leg means include rolling means which automatically operate to engage a floor surface in response to the operation of said leg means to raise said bed frame to substantially its uppermost position and render said bed horizontally mobile on the rolling means only at said substantially uppermost position.

The present invention in yet another embodiment provides a bed frame comprising a pair of spaced apart transverse frame elements inward of each end of the bed frame, having a pair of rod guide means therebetween rigidly connected at each end to said transverse frame elements. The guide means have a bearing element and a spring element circumferentially mounted thereon. The bearing element is movable along the length of the guide means to engage as well as to compress the spring element at one end thereof against said transverse frame element and wherein the motor power consists of a linear actuator operatively attached to the bearing element.

The present invention in yet another embodiment provides leg means comprising a substantially inverted U shaped leg frame member having a pair of downwardly extending legs, collapsibly attached to the underside of said bed frame by means of a first pinned connection at the top thereof between the leg frame and the bearing element and a second pinned linkage connection between one end of the bed frame and substantially the midpoint of the leg frame member.

The present invention in yet another embodiment provides rolling means comprising a flange having a slot therethrough and opposite ends, said flange rotatably attached to the bottom of each said leg of the leg frame member and constrained to rotationally pivot with respect thereto by means of a pin member extending from the bottom of each said leg passing through said slot, each said opposite end having attached thereto respectively a fixed leg member and a caster member. The slot in the flange has a convex arcuate shape with reference to the floor surface. Each of said downwardly extending legs may be rigidly connected at its bottom end by a transverse leg frame member and said rolling means may be optionally rotationally attached to said transverse leg frame member.

The present invention in yet another embodiment provides a bed, having a bed frame and a pair of motor powered leg means operable to vertically raise and lower said bed frame over a range of heights between a lowermost and uppermost position. The bed frame comprises a pair of spaced apart transverse frame elements inward of each end of the bed frame, having a pair of rod guide means therebetween rigidly connected at each end to said transverse frame elements, said guide means having a bearing element and a spring element circumferentially mounted thereon, said bearing element movable along the length of the guide means to engage as well as to compress the spring element at one end thereof against said transverse frame element. The motor power consists of a linear actuator operatively attached to the bearing element to thereby move said bearing element longitudinally along said guide means. The leg means comprises a substantially inverted U shaped leg frame member having a pair of downwardly extending legs, collapsibly attached to the underside of said bed frame by means of a first pinned connection at the top thereof between the leg frame and the bearing element and a second pinned linkage connection between one end of the bed frame and substantially the midpoint of the leg frame member. Castor wheels may be attached to the bottom of each leg.

Further features of the invention will be described or will become apparent in the course of the following detailed description.

BRIEF DESCRIPTION OF THE DRAWINGS

In order that the invention may be more clearly understood, a preferred embodiment thereof will now be described in detail by way of example, with reference to the accompanying drawings, in which.

PREFERRED EMBODIMENT

Figure 1:
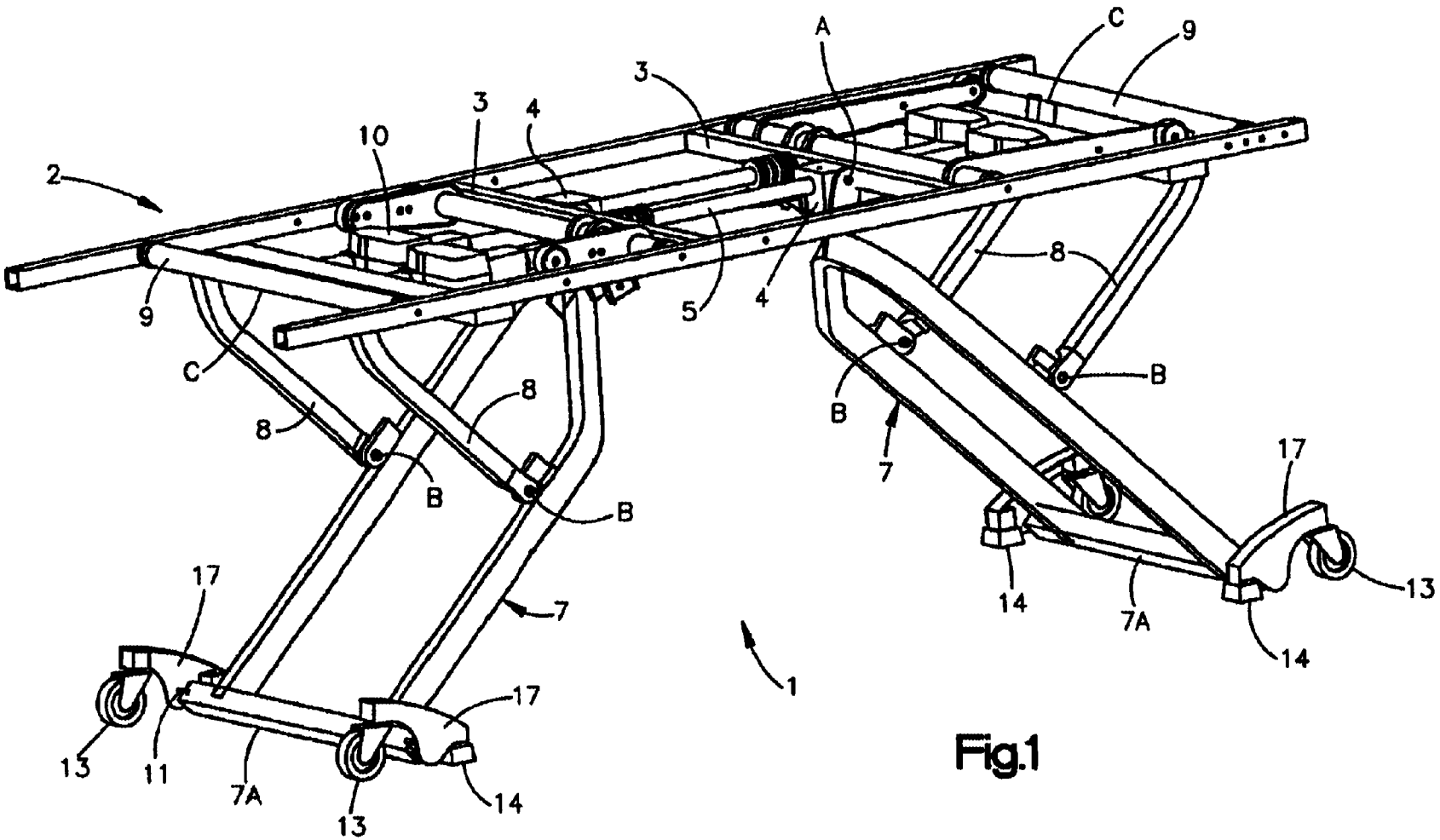
FIG. 1 is a perspective view of the mechanical bed frame and leg arrangement shown in the highest position.

Referring to FIG. 1, a vertically adjustable bed 1 is shown having a rectangular like bed frame 2 which has cross members 3 and 9 which gives the bed frame its rigidity.

The leg arrangement associated at each end of the bed consists of a inverted U shaped main leg frame member 7 which is pivotally and movably attached to the bed frame by means of bearing block 4 at pivot point A. This arrangement allows the top of the leg frame member 7 to follow the bearing block as it travels longitudinally along the linear guide 5 in response to the movement of a linear actuator associated with the motor means 10. The bearing block consists of a square like block having a circular aperture therethrough. The operation of the motor moves the bearing block 4 by means of the linear actuator longitudinally along the linear guide rod 5. This action causes the main frame leg to collapse and lower or extend and rise under the bed.

Returning to the leg arrangement, the main leg frame member 7 is pivotally attached at its mid point B to one end of a linkage arm 8. The other end of the linkage arm 8 is fixedly attached at C to a rotatable sleeve on cross member 9. It should be noted that the pivot points A, B and C are equidistant from one another which permits the vertical up and down motion of the bed in response to the movement of the bearing block along the linear guide by means of the linear actuator. In operation, the movement of the bearing block along the linear guide rod 5 will either rotationally collapse or raise the main leg.

One problem with raising a bed from its lowermost position is the greater motor power required to initiate the raising sequence action. This is because there is no effective angle θ between the main leg frame member 7 and the bed frame 2 as shown in FIG. 1. When collapsed, the main leg frame member 7 is tucked under the bed frame and is virtually parallel thereto. The angle θ is effectively zero. For this reason, spring members 6 are provided at each end of the linear guide rod mounted circumferentially thereon and optionally fixedly attached to one of the transverse cross-members 3 as shown or to the bottom of the leg. Referring to the earlier description of the operation of the bed, when lowering the bed the front face of the bearing block 4 will eventually come into contact with and engage the spring 6. Further lowering action will cause the spring 6 to longitudinally compress between the bearing block and the transverse cross-member. Full compression occurs at the lowermost position. When the bed is sought to be raised the energy in the compressed spring 6 acts on the front face of the bearing block 4 to initiate the first or initial movement along the linear guide rod without reliance on the motor at this most critical point. Once movement has been started by the spring and an effective angle θ established, the motor is able to take over to easily raise the bed.

Figure 2:
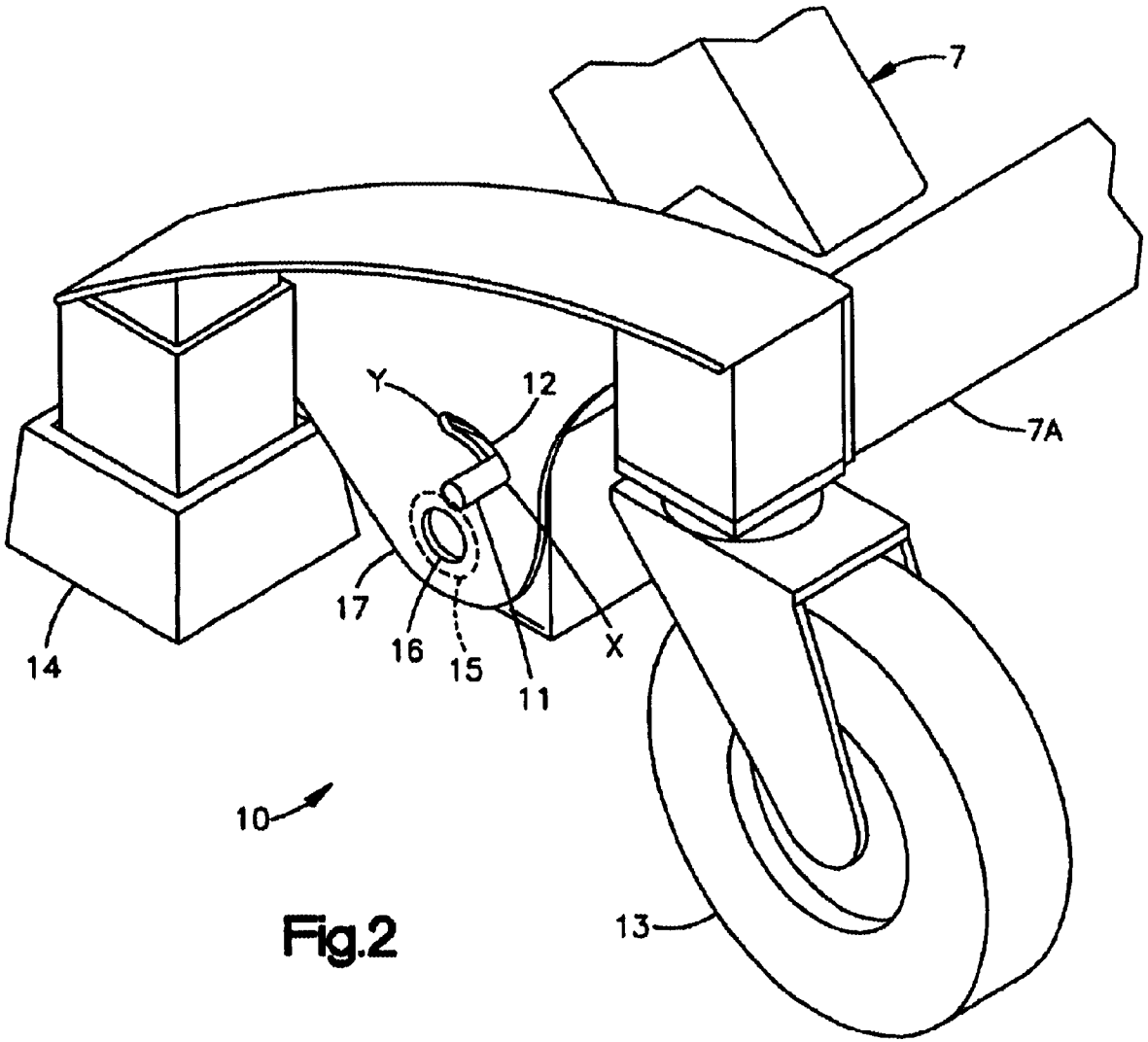
FIG. 2 is a perspective partly sectional view of the foot/caster leg arrangement.
Figure 3:
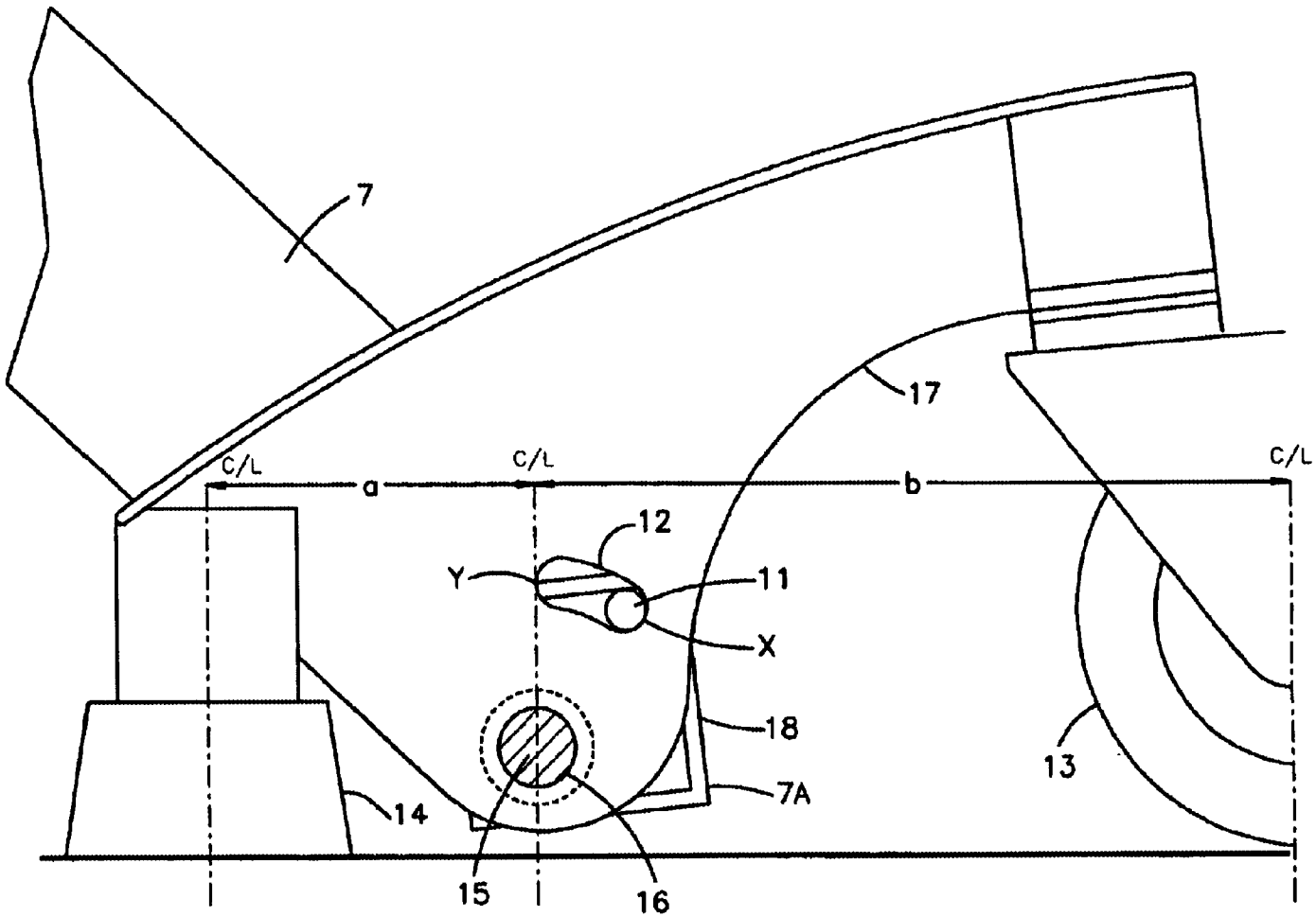
FIG. 3 is a side, partly sectional view, of the foot/caster leg arrangement.

The operation of the special foot/caster leg arrangement will now be described with reference to FIGS. 2 and 3. It can be seen that each open end of the U shaped main leg frame member 7 is connected by a rigidly attached horizontal cross frame member 18. According to this invention, a foot/caster leg is rotationally or pivotally attached at each end of cross member 18 by means of a shoulder bolt (non shown) passing through hole 16 in the flange 17 to which the foot 14 and caster 13 are attached at either end. As such, and with reference to FIG. 3, the center line of the caster 13 is distance B from the center line passing through the shoulder bolt. The center line of the foot 14 is distance A from the center line passing through the pin 15. The caster and foot are thus separated from one another by a ratio of B:A. Further operation of the foot/caster leg arrangement is now described.

As the bed is lowered or raised, a dog or pin 11 which is fixedly attached and outwardly extends from each end of the cross leg member 18, will move in an arcuate fashion by reason of its off center location with reference to the longitudinal center line of the cross member 18. The arcuate movement of the dog or pin 11 is achieved as a function of rotation of the main leg frame member 7. The dog or pin 11 is aligned and constrained within an arcuate slot 12 in the flange. Thus, and with reference to FIG. 3, when the bed as in the example shown is in its upper most position, the dog 11 will have moved clockwise in the arcuate slot 12 to the position shown in 3, thus engaging the flange at the point of contact X as shown. Further movement of the dog as the bed is raised causes the flange to rotate in a clockwise direction onto the caster wheel. Correspondingly, the foot will come off the ground. The reverse action will cause the dog 11 to rotate counter clock wise within the arcuate slot 12 ultimately into disengagement with the end of the slot X and towards the other end of the slot Y wherein the foot will fully engage the floor. It is the constraint of the dog within the arcuate slot which ensures that, excepting only one intermediate position, only the leg or caster are in contact with the floor but not both. It can be seen that the pivot distances B and A (ratio B:A) shown in FIG. 3 can be geometrically matched and sized to the length of the arcuate slot 12 to ensure that the foot 14 comes off the floor at or about the uppermost travel position of the bed. Further movement of the bed to its highest position causes the foot/caster leg to pivot to fully engage the caster wheels with the floor. Thus, the bed remains fixed on the ground through most of the vertical travel sequence.

The particular arrangement shown for the pin is not essential. What is important is to use the rotational motion at the bottom of the leg or horizontal base frame member by some means such as a pin to engage one end of a slot or channel to obtain the desired action. As such, the pin can be made to extend upwardly at right angles to the longitudinal axis of the horizontal base frame member and the foot/caster can be adapted with an interior channel within which the pin can move to engage one end of the channel.

A second foot/caster leg on the other end of cross member 18 operates in the same identical fashion but in reverse with respect to the description of the clock wise and the counter clock wise travel directions of the dog 11 within the arcuate slot 12. Obviously, the other main leg frame is equipped identically and operates in an identical and complementary fashion. All of the actions are synchronized to achieve the objects of this invention. As well, the foot caster may be optionally attached to the bottom of the leg and made to function in like fashion.

From the foregoing, it will be seen that this invention is one well adapted to attain all the ends and objects hereinabove set forth together with other advantages which are obvious and which are inherent to, the structure.

It will be understood that certain features and sub-combinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having described the invention, what is claimed is:

1. A bed that can be supported on a floor, having a bed frame and a pair of motor powered leg mechanisms operable to vertically raise and lower the bed frame between a lowermost and an uppermost position, each one of the pair of leg mechanisms including rolling means, the rolling means comprising a fixed leg member, the fixed leg member engaging the floor when the bed frame is in the lowermost position and disengaging the floor when the bed flame is raised to thereby render the bed horizontally mobile on the rolling means only at substantially the uppermost position;

wherein said bed frame comprises a pair of spaced apart transverse frame elements inward of each end of the bed frame, having a pair of rod guide means there between rigidly connected at each end to said transverse frame elements, said guide means having a bearing element and a spring element circumferentially mounted thereon, said bearing element movable along the length of the guide means to engage as well as to compress the spring element at one end thereof against said transverse frame element and wherein said motor power consists of a linear actuator operatively attached to the bearing element.

2. A bed that can be supported on a floor, having a bed frame and a pair of motor powered leg mechanisms operable to vertically raise and lower the bed frame between a lowermost and an uppermost position, each one of the pair of leg mechanisms including rolling means, the rolling means comprising a fixed leg member, the fixed leg member engaging the floor when the bed frame is in the lowermost position and disengaging the floor when the bed frame is raised to thereby render the bed horizontally mobile on the rolling means only at substantially the uppermost position;

wherein each of said leg mechanisms comprises a substantially inverted U shaped leg frame member having a pair of downwardly extending legs, collapsibly attached to the underside of said bed frame by means of a first pinned connection at the top thereof between the leg frame member and the bearing element and a second pinned linkage connection between one end of the bed frame and substantially the midpoint of the leg frame member.

3. The bed as claimed in claim 2, wherein said fixed leg member is a foot and said rolling means further comprises a castor member.

4. The bed as claimed in claim 2, wherein said rolling means comprises a flange having a slot therethrough and opposite ends, said flange rotatably attached to the bottom of each said leg of the leg frame member and constrained to rotationally pivot with respect thereto by means of a pin member extending from the bottom of each said leg and passing through said slot, each said opposite end having attached thereto respectively a fixed leg member and a caster member.

5. The bed as claimed in claim 4, wherein said slot in said flange has a convex arcuate shape with reference to the floor.

6. The bed as claimed in claim 2, wherein each of said downwardly extending legs is rigidly connected at its bottom end by a transverse leg frame member and said rolling means is rotationally attached to said transverse leg frame member.

7. The bed as claimed in claim 6, wherein said rolling means comprises a flange having a slot therethrough and opposite ends, said flange rotatably attached to either end of the transverse leg flame member and constrained to rotationally pivot with respect thereto by means of a pin member extending from said transverse leg frame member and passing through said slot, each said opposite end having attached thereto respectively a fixed leg member and a caster member.

8. The bed as claimed in claim 7, wherein said slot in said flange has a convex arcuate shape with reference to the floor.

9. A bed, having a bed frame and a pair of motor powered leg mechanisms operable to vertically raise and lower said bed frame over a range of heights between a lowermost and uppermost position:

(a) wherein said bed frame comprises a pair of spaced apart transverse frame elements inward of each end of the bed frame, having a pair of rod guide means therebetween rigidly connected at each end to said transverse frame elements, said guide means having a bearing element and a spring element circumferentially mounted thereon, said bearing element movable along the length of the guide means to engage as well as to compress the spring element at one end thereof against said transverse frame element;

(b) wherein said motor power consists of a linear actuator operatively attached to the bearing element to thereby move said bearing element longitudinally along said guide means;

c) wherein each of said leg mechanisms comprises a substantially inverted U shaped leg frame member having a pair of downwardly extending legs, collapsibly attached to the underside of said bed frame by means of a first pinned connection at the top thereof between the leg frame member and the bearing element and a second pinned linkage connection between one end of the bed frame and substantially the midpoint of the leg frame member.

10. The bed as claimed in claim 9, wherein each of said downwardly extending legs includes rolling means attached to the bottom thereof.

11. The bed as claimed in claim 10, wherein each of said downwardly extending legs is rigidly connected at its bottom end by a transverse leg frame member and wherein said rolling means is attached to the end of said transverse leg frame member.

12. The bed as claimed in claim 9, wherein said bearing element is made of a dry lubricant plastic.

13. A bed for use on a floor, comprising:

a bed frame;

first and second legs disposed at opposite ends of the bed that support the bed frame for vertical movement relative to the floor between an uppermost position and a lowermost position and a plurality of intermediate positions;

each one of the first and second legs having a respective upper end portion movably connected to the bed frame and having a respective lower end pardon that includes a wheel and a foot, the lower end portion being movable vertically relative to the bed frame upon movement of the leg relative to the bed frame;

the wheels of the first and second legs engaging the floor when the bed frame is in the uppermost position and being spaced upward from the floor when the frame is in the lowermost position; and the feet of the first and second legs engaging the floor when the bed frame is in the lowermost position and in the plurality of intermediate positions;

wherein the upper end portions of the first and second legs are movable in a direction along the length of the bed frame during vertical movement of the bed frame.

14. A bed as set forth in claim 13 wherein, in response to movement of the upper end portions of the first and second legs in a direction along the length of the bed frame, the lower end portions of the first and second legs change over between a first condition in which the wheels and not the feet are in engagement with the floor and a second condition in which the feet and not the wheels are in engagement with the floor.

15. A bed as set forth in claim 14 wherein the lower end portions of the legs change over in response to movement of the bed frame into and out of the uppermost position.

16. A bed for use on a floor, comprising:

a bed frame;

first and second legs disposed at opposite ends of the bed that support the bed frame for vertical movement relative to the floor between an uppermost position and a lowermost position and a plurality of intermediate positions;

each one of the first and second legs having a respective upper end portion movably connected to the bed frame and having a respective lower end portion that includes a wheel and a foot, the lower end portion being movable vertically relative to the bed frame upon movement of the leg relative to the bed frame;

the wheels of the first and second legs engaging the floor when the bed frame is in the uppermost position and being spaced upward from the floor when the frame is in the lowermost position; and the feet of the first and second legs engaging the floor when the bed frame is in the lowermost position and in the plurality of intermediate positions;

wherein at least one end portion of each one of the first and second legs moves longitudinally when the bed frame moves vertically.

17. A bed for use on a floor, comprising:

a bed frame;

first and second legs disposed at opposite ends of the bed that support the bed frame for vertical movement relative to the floor between an uppermost position and a lowermost position and a plurality of intermediate positions including an upper intermediate position;

each one of the first and second legs having a respective upper end portion movably connected to the bed frame and having a respective lower end portion that includes a wheel and a foot, the lower end portion being movable vertically relative to the bed frame upon movement of the leg relative to the bed frame;

each one of the lower and portions of the legs including a leg member and a support member that is rockably connected to the leg member at an attachment point, the foot and the wheel being supported on the support member on opposite sides of the attachment point for rocking movement with the support member.

18. A bed as set forth in claim 17 wherein the support member is a flange.

19. A bed as set forth in claim 17 wherein:

the feet and not the wheels of each of the first and second legs engage the floor when the bed is in the lowermost position; and the wheels and not the feet of each of the first and second legs engage the floor when the bed is in the uppermost position.

20. A bed as set forth in claim 17 wherein the leg member includes a portion that engages the support member to cause rocking movement of the support member in response to movement of the bed frame into and out of the uppermost position.

21. A bed as set forth in claim 20 wherein the leg member portion is a pin that engages in a slot in the support member to cause rocking movement of the support member.

22. A bed for use on a floor, comprising:

a bed frame;

first and second legs disposed at opposite ends of the bed that are connected to the bed frame for movement relative to the bed frame through a range of motion and that support the bed frame for vertical movement relative to the floor between an uppermost position and a lowermost position and a plurality of intermediate positions including an upper intermediate position;

each one of the first and second legs having a respective upper end portion connected to the bed frame and having a respective lower end portion that is for engaging the floor and that includes a wheel and a foot, on each leg the foot and the wheel being alternatively engageable with the floor in response to movement of the leg through its range of motion relative to the bed frame;

wherein the lower end portion of each leg includes a leg member and a rockable support member that is connected with the leg member and that supports the foot and the wheel.

23. A bed as set forth in claim 22 wherein the leg member includes a portion that engages the support member to cause rocking movement of the support member relative to the leg member in response to movement of the bed frame into and out of the uppermost position.

24. A bed as set forth in claim 22 wherein on each one of the first and second legs the wheel and the foot are connected to the support member on opposite sides of the point of attachment of the support member to the leg member.

25. A bed for use on a floor, comprising:

a bed frame;

first and second legs disposed at opposite ends of the bed that are connected to the bed frame for movement relative to the bed frame through a range of motion and that support the bed frame for vertical movement relative to the floor between an uppermost position and a lowermost position and a plurality of intermediate positions including an upper intermediate position;

each one of the first and second legs having a respective upper end portion connected to the bed frame and having a respective lower end portion that is for engaging the floor and that includes a wheel and a foot, on each leg the foot and the wheel being alternatively engageable with the floor in response to movement of the leg through its range of motion relative to the bed frame;

wherein the legs are connected to the frame for pivotal movement relative to the frame and wherein the upper end portions of the leg are also movable along the length of the bed frame.

26. A bed for use on a floor, comprising:

a bed frame;

first and second legs disposed at opposite ends of the bed that are connected to the bed frame for movement relative to the bed frame through a range of motion and that support the bed frame for vertical movement relative to the floor between an uppermost position and a lowermost position and a plurality of intermediate positions including an upper intermediate position;

each one of the first and second legs having a respective upper end portion connected to the bed frame and having a respective lower end portion that is for engaging the floor and that includes a wheel and a foot, on each leg the foot and the wheel being alternatively engageable with the floor in response to movement of the leg through its range of motion relative to the bed frame;

wherein, in response to movement of the upper end portions of the first and second legs in a direction along the length of the bed frame the lower end portions of the first and second legs change over between a first condition in which the wheels and not the feet are in engagement with the floor and a second condition in which the feet and not the wheels are in engagement with the floor.

27. A bed as set forth in claim 26 wherein the lower end portions of the legs change over in response to movement of the bed frame into and out of the uppermost position.

28. A bed for use on a floor, comprising:

a bed frame; and first and second leg mechanisms disposed at opposite ends of the bed for supporting the bed frame for vertical movement relative to the floor between an uppermost position and a lowermost position and a plurality of intermediate positions including an upper intermediate position, said first and second leg mechanisms being connected to the bed frame for movement relative to the bed frame through a range of motion;

each one of the first and second legs mechanisms having a respective upper end portion connected to the bed frame and having a respective lower end portion that is for engaging the floor and that includes a wheel and a foot, on each leg the foot and the wheel being alternatively engageable with the floor in response to movement of the leg through its range of motion relative to the bed frame;

wherein the leg mechanisms are connected to the frame for pivotal movement relative to the frame and wherein the upper end portions of the leg mechanisms are also movable along the length of the bed frame.

29. A bed for use on a floor, comprising:

a bed frame; and first and second leg mechanisms disposed at opposite ends of the bed for supporting the bed frame for vertical movement relative to the floor between an uppermost position and a lowermost position and a plurality of intermediate positions including an upper intermediate position, said first and second leg mechanisms being connected to the bed frame for movement relative to the bed frame through a range of motion;

each one of the first and second legs mechanisms having a respective upper end portion connected to the bed frame and having a respective lower end portion that is for engaging the floor and that includes a wheel and a foot, on each leg the foot and the wheel being alternatively engageable with the floor in response to movement of the leg through its range of motion relative to the bed frame;

wherein, in response to movement of the upper end portions of the first and second leg mechanisms in a direction along the length of the bed frame, the lower end portions of the first and second leg mechanisms change over between a first condition in which the wheels and not the feet are in engagement with the floor and a second condition in which the feet and not the wheels are in engagement with the floor.

30. A bed as set forth in claim 29 wherein the tower and portions of the leg mechanisms change over in response to movement of the bed frame into and out of the uppermost position.

* * * * *